US005812058A

United States Patent [19]

Sugimoto et al.

[11] Patent Number: 5,812,058

[45] Date of Patent: Sep. 22, 1998

[54] SECURITY SENSOR WITH BUILT-IN SIGHT

[75] Inventors: Tadashi Sugimoto; Yoshihiro Imuro; Mataichi Kurata, all of Otsu, Japan

[73] Assignee: Optex Co., Ltd., Shiga, Japan

[21] Appl. No.: 864,385

[22] Filed: May 28, 1997

[30] Foreign Application Priority Data

Jul. 23, 1996 [JP] Japan ..... 8-213049

[51] Int. Cl.[6] ..... G08B 13/183

[52] U.S. Cl. ..... 340/556; 340/501; 340/693

[58] Field of Search ..... 340/556, 557, 340/693, 501

[56] References Cited

U.S. PATENT DOCUMENTS

| | | | |
|---|---|---|---|
| 3,752,978 | 8/1973 | Kahl, Jr. et al. | 250/340 |
| 5,334,972 | 8/1994 | Sugimoto et al. | 340/556 |
| 5,596,310 | 1/1997 | Itoh | 340/557 |

FOREIGN PATENT DOCUMENTS

| | | |
|---|---|---|
| 0 005 853 A1 | 12/1979 | European Pat. Off. . |
| 0 466 522 A1 | 1/1992 | European Pat. Off. . |
| 49-41143 | 7/1947 | Japan . |
| 06068366 | 3/1994 | Japan . |

*Primary Examiner*—Glen Swann

*Attorney, Agent, or Firm*—Hamilton, Brook, Smith & Reynolds, P.C.

[57] ABSTRACT

A security sensor equipped with a sighting device in which respective optical axes of a beam projector and a beam receiver can be adjusted easily and quickly. The beam receiver A includes an adjustment (50) for adjusting the optical axis, a mirror-equipped sighting device (C) having a viewing window (12) through which viewing is possible from a lateral side of the beam receiver (A), a light emitting element (8) and a mirror (14) accommodated therein for presenting an image of the beam projector (B), and a lamp control (6) for changing a status of the light emitting element (8) in correspondence with the amount of light received from the beam projector (B).

9 Claims, 8 Drawing Sheets

SECURITY SENSOR WITH BUILT-IN SIGHT

BACKGROUND OF THE INVENTION

1. Field of the Invention

The present invention generally relates to a security sensor comprising a beam projector, a beam receiver and a sighting device for adjustment of respective optical axes of the beam projector and beam receiver and, more particularly, to improvement in workability of the adjustment of the optical axes thereof.

2. Description of the Prior Art

In general, an active-type infrared security sensor comprises a beam projector having a light emitting element, a beam receiver having a light receiving element and a sighting device and is so designed and so constructed that while an infrared beam projected from the beam projector is received by the beam receiver, the presence of an object can be detected when the infrared beam is intercepted. In such case, the sighting device is utilized for adjustment of respective optical axes of the beam projector and receiver, and while an attendant worker or user looks at the sighting devices provided respectively in the beam projector and receiver, one or both of vertical and horizontal angles of the beam receiver are adjusted to adjust the optical axes with naked eyes. After the adjustment, while the use is made of a tester to measure the level of the infrared beam projected from the beam projector and received by the beam receiver, a final adjustment of the optical axes is performed by finely adjusting one or both of the vertical and horizontal angles of the beam receiver to an extent sufficient to permit the level of the received beam to attain a predetermined value.

However, the prior art security sensor has a problem. More specifically, since during the adjustment of the optical axes that is being performed while the attendant worker or user looks at the sighting device, the position of an image of the beam projector is apt to displace with change in angle at which the attendant worker or user views the sighting device and, therefore, an exact alignment of the optical axis of the beam receiver is difficult to achieve. In fact, measurement of the level of the beam being received by the use of the tester while the attendant worker or user believes that the optical axes would have accurately been adjusted has indicated the presence of a case in which no level of the beam received has attained the predetermined value.

The Japanese Utility Model Application No. 49-41143 discloses the sighting device of a design wherein the optical axis is adjusted by looking at the sighting device in the beam receiver from rear of the beam receiver.

SUMMARY OF THE INVENTION

The present invention has been developed to substantially eliminate the above discussed problems and is intended to provide an improved security sensor equipped with a sighting device in which the respective optical axes of the beam projector and receiver can be easily and quickly adjusted.

To this end, the present invention in accordance with one preferred embodiment thereof provides a security sensor equipped with a sighting device, comprising a beam projector having a beam projecting element, a beam receiver having a light receiving element for receiving a beam emitted from the beam projector, and a sighting device for adjusting an optical axis. The beam receiver comprises an adjusting means for adjusting the optical axis; a mirror-equipped sighting device having a viewing window through which viewing is possible from a lateral side of the beam receiver, and including a mirror accommodated therein for presenting an image of the beam projector and a light emitting element which is turned on at the time of adjustment of the optical axis; and a lamp control means for changing a status of the light emitting element in correspondence with the amount of light received from the beam projector. It is to be noted that the optical axis of the beam receiver is intended to mean the direction in which the amount of light received by the beam receiver is maximized.

According to the present invention, since the optical axis adjustment can be carried out by viewing through the viewing window of the sighting device from a lateral side of the beam receiver to ascertain the level of the light being received in reference to the status of the light emitting element which varies with the amount of the light received from the beam projector, adjustment of the optical axis to an extent sufficient to permit the level of the received beam to attain a predetermined value can be facilitated. Accordingly, the subsequent final adjustment with the use of the tester can also be facilitated. In addition, the structure is simple and can be manufactured at a reduced cost.

Preferably, the light emitting element may be disposed in the vicinity of the mirror and at such a position that when viewed through the viewing window the field of view of the mirror will not be intercepted. In such case, the light emitting element and the mirror will not overlap with each other and, therefore, a job of optical axis adjustment can easily be performed.

Also preferably, the viewing window and the mirror of the sighting device may be provided for each of left and right sides and the light emitting element is disposed therebetween. The use of the two pairs of the viewing window and the mirror allows the attendant worker or user to choose one of left and right viewing windows to be viewed depending on the location where the security sensor is installed.

Again preferably, the lamp control means may be of a type capable of causing the light emitting element to be selectively turned on, blink and turned off in dependence on the amount of light received from the beam projector. This ensures an accurate optical axis adjustment since it can be accomplished by looking at the status of the light emitting element.

Alternatively, the lamp control means may be of a type capable of changing the color of the light emitting element in dependence on the amount of light received from the beam projector. In such case, an accurate optical axis adjustment can be accomplished by looking at a change in color of the light emitting element.

In either case, the lamp control means may be of a type capable of switching the light emitting element off when the orientation of the optical axis is within a tolerance. According to this feature, the amount of an electric power consumed by the light emitting element after the optical axis adjustment can advantageously be reduced to accomplish an energy saving.

Yet preferably, the viewing window may be provided with a field limiting frame member having a length greater than twice an aperture size. The use of the field limiting frame member ensures that the attendant worker or user can with no doubt look at the mirror, not the light emitting element then lit.

The light emitting element may be of a type having an alarm function with which a lighting condition varies when a beam which the beam receiver receives from the beam projection is intercepted. According to this feature, the light emitting element can be used concurrently for dual purposes of a warning display and an optical axis adjustment.

The adjusting means may preferably include a manually operated dial rotatable about a first axis, and a gear trail drivingly associated with the manually operated dial for rotating a holder for holding the light receiving element about the first axis. According to this feature, adjustment in position of the light receiving element in a direction about the first axis can easily be performed.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figures 1A, 1B:
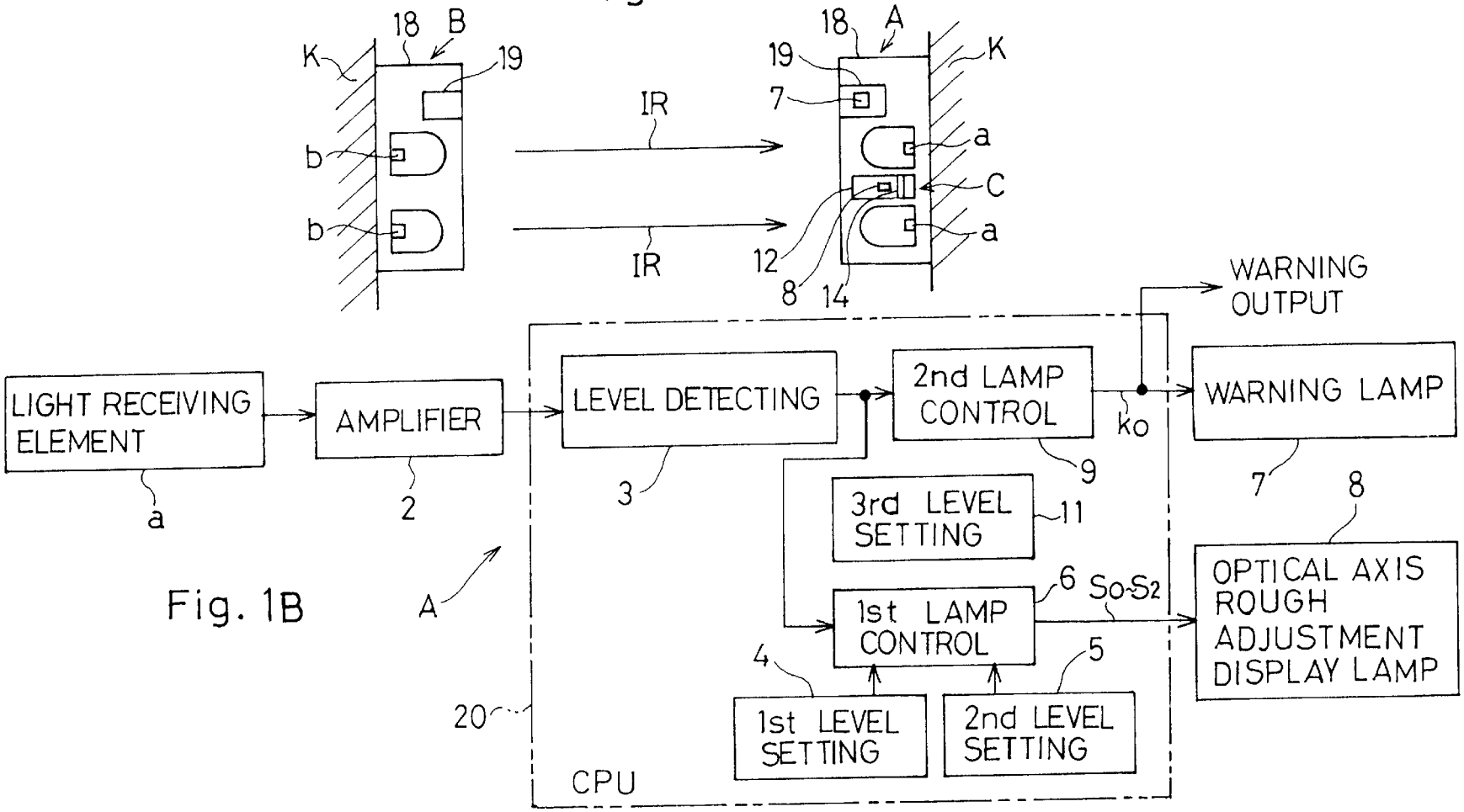
FIG. 1A is a schematic side view of a security sensor equipped with a sighting device according to a first preferred embodiment of the present invention.
FIG. 1B is a circuit block diagram showing a beam receiver forming a part of the security sensor.

Referring first to FIG. 1A, there is shown a schematic diagram of a security sensor having a sight built therein according to a first preferred embodiment of the present invention. The security sensor shown therein comprises a beam projector B, including first and second beam projecting elements b, and a beam receiver A including first and second light receiving elements a for receiving infrared beams IR emitted from the beam projector B. Both of the beam projector B and the beam receiver A are accommodated within a housing 18 which may be secured to a suitable support such as, for example, a wall or a support pole. The security sensor is so designed and so operable that unless the infrared beam IR emitted from the beam projector B is intercepted, a warning lamp 7, such as, for example, a light emitting diode, included in the beam receiver A can be kept turned off, but the warning lamp 7 can be turned on when the infrared beam IR is intercepted.

Figure 4:
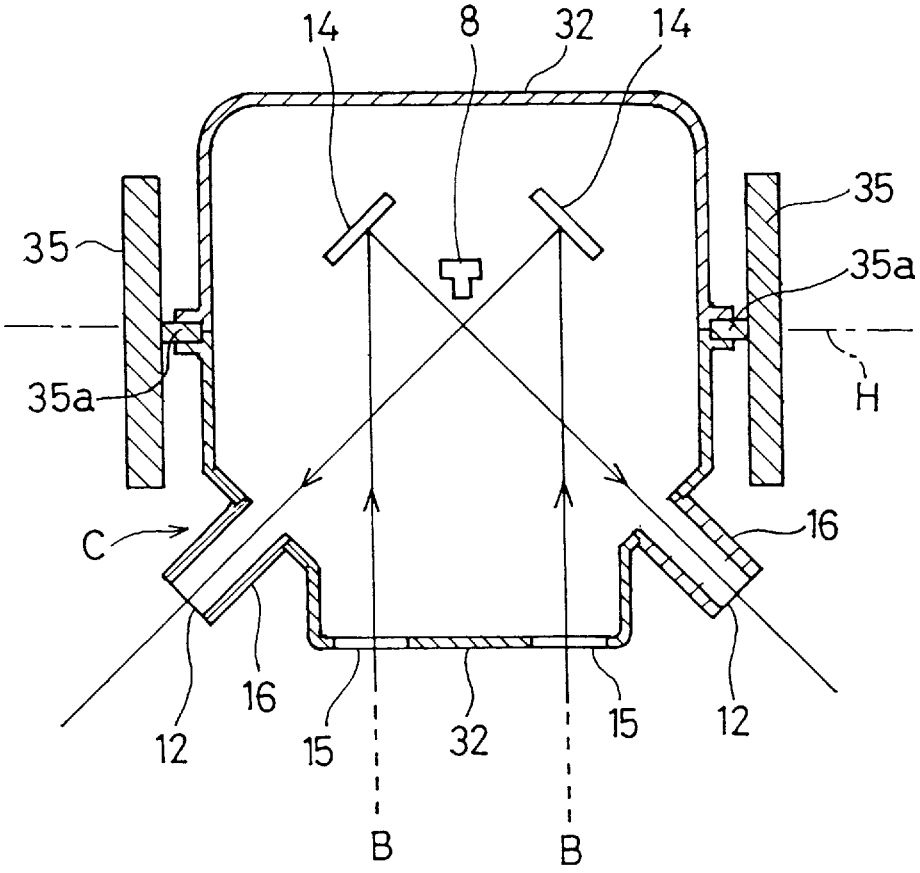
FIG. 4 is a cross-sectional view taken along the line IV—IV in FIG. 3.

The beam receiver A includes a mirror-equipped sighting device C for adjustment of an optical axis between the beam projector B and the beam receiver A. The sighting device C has viewing windows 12 for viewing from one side of the beam receiver A and includes, as shown in FIG. 4, mirrors 14 housed therein for presenting an image of the beam projector B and an optical axis rough adjustment display lamp 8 such as, for example, a light emitting diode. When the optical axis between the beam projector B and the beam receiver A is to be adjusted, the attendant worker or user has to view an operating status of the optical axis rough adjustment display lamp 8 so that the orientation of the optical axis through the viewing windows 12 can be adjusted by an adjusting means 50 as will be described later. It is to be noted that the beam projector B is of any known construction capable of generating and projecting the infrared beam IR.

Referring to FIG. 1B, an electric signal outputted from the light receiving element a and having a magnitude proportional to the amount of light received by the light receiving element a is amplified by an amplifier circuit 2 and the signal intensity of the amplified signal emerging from the amplifier circuit 2, that is, the amount of change of a bundle of infrared rays received by the light receiving element a, is monitored at all times by a level detecting means 3. This level detecting means 3 detects the signal level of the electric signal inputted thereto so that the signal level so detected can be subsequently supplied to a first lamp control means 6, and a second lamp control means 9 operable to switch the warning lamp 7 on.

The first lamp control means 6 is operable to cause the optical axis rough adjustment display lamp 8 to assume one of turn-on, blinking and turn-off conditions depending on the amount of light received from the beam projector B. In other words, the first lamp control means 6 compares at all times the signal level detected by the level detecting means 3 with first and second preset levels set respectively by first and second level setting means 4 and 5 and outputs one of lamp control signals S0, S1 and S2 according to the relevant level. More specifically, when the signal level is of a value not exceeding the first preset level and hence indicates that the orientation of the optical axis is not aligned, the first lamp control means 6 outputs the lamp control signal S0; when the signal level is of a value exceeding the first preset level, but not exceeding the second preset level and hence indicates that the orientation of the optical axis is within a tolerance, the lamp control means 6 outputs the lamp control signal S1; and when the signal level is of a value exceeding the second preset level and hence indicates that the orientation of the optical axis is aligned, the first lamp control means 6 outputs the lamp control signal S2.

The first lamp control means 6 causes the optical axis rough adjustment display lamp 8 to be turned on in response to the lamp control signal S0 to thereby indicate that the orientation of the optical axis is not aligned; causes the optical axis rough adjustment display lamp 8 to blink in response to the lamp control signal S1 to thereby indicate that the orientation of the optical axis is within the tolerance; and causes the optical axis rough adjustment display lamp 8 to be turned off to thereby indicate that the orientation of the optical axis is aligned. The second lamp control means 9 outputs a warning signal k0, when the signal level detected by the level detecting means 3 exceeds a third preset level set by a third level setting means 11, to thereby cause the warning lamp 7 to be turned on and also supplies a warning output to the outside. The first and second level setting means 4 and 5 and the first and second lamp control means 6 and 9 are built in a central processing unit (CPU) 20.

It is to be noted that the optical axis rough adjustment display lamp 8 may be of a type including two light emitting diodes capable of emitting, for example, red and green rays of light when turned on. In such case, the first lamp control means 6 has to be of a design capable of causing one of the light emitting diodes to emit the red rays of light in response to an output of the lamp control signal S0; causing such one of the light emitting diode to be deenergized and, on the other hand, the other of the light emitting diode to emit the green rays of light in response to an output of the lamp control signal S1; and causing both of the light emitting diodes to be deenergized in response to an output of the lamp control signal S2.

Figure 6:
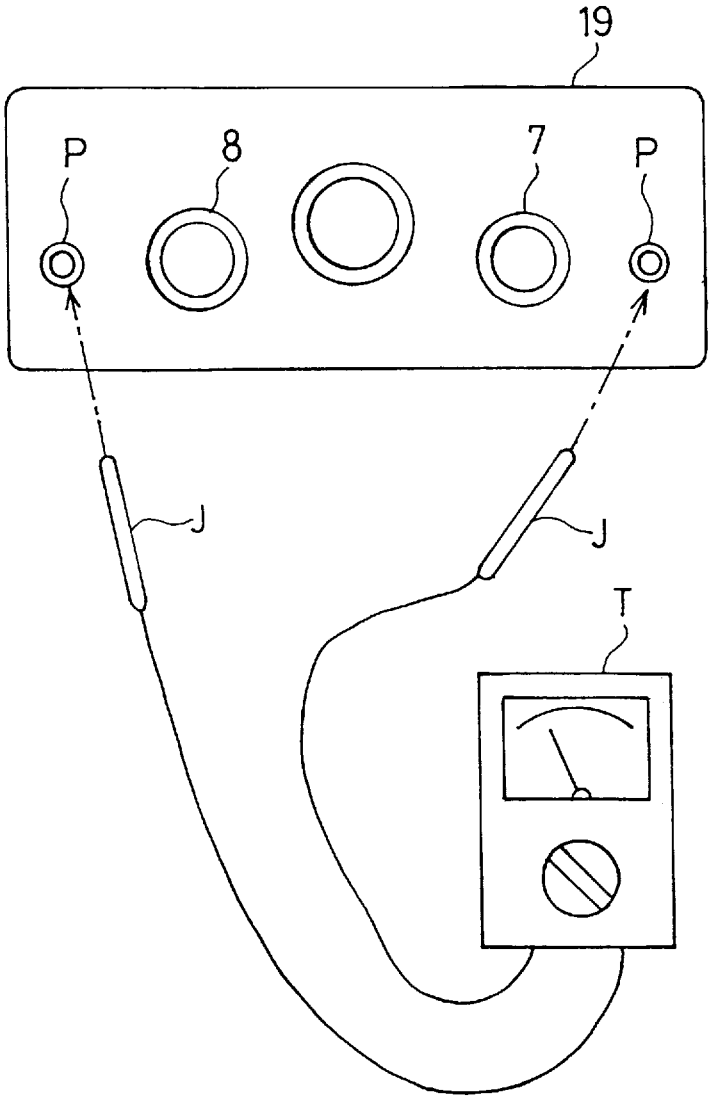
FIG. 6 is a front elevational view showing a display unit.

A display unit 19 shown in FIG. 6 is provided with a plurality of, for example, two, pin holes P adapted to receive therein corresponding monitor jacks J that are connected with a tester T to enable the signal level of the electric signal generated from the level detecting means 3 to be ascertained and a final adjustment is carried out by means of adjustment of the adjusting means 50 so that the signal level can be of a level higher than a predetermined value.

Figure 3:
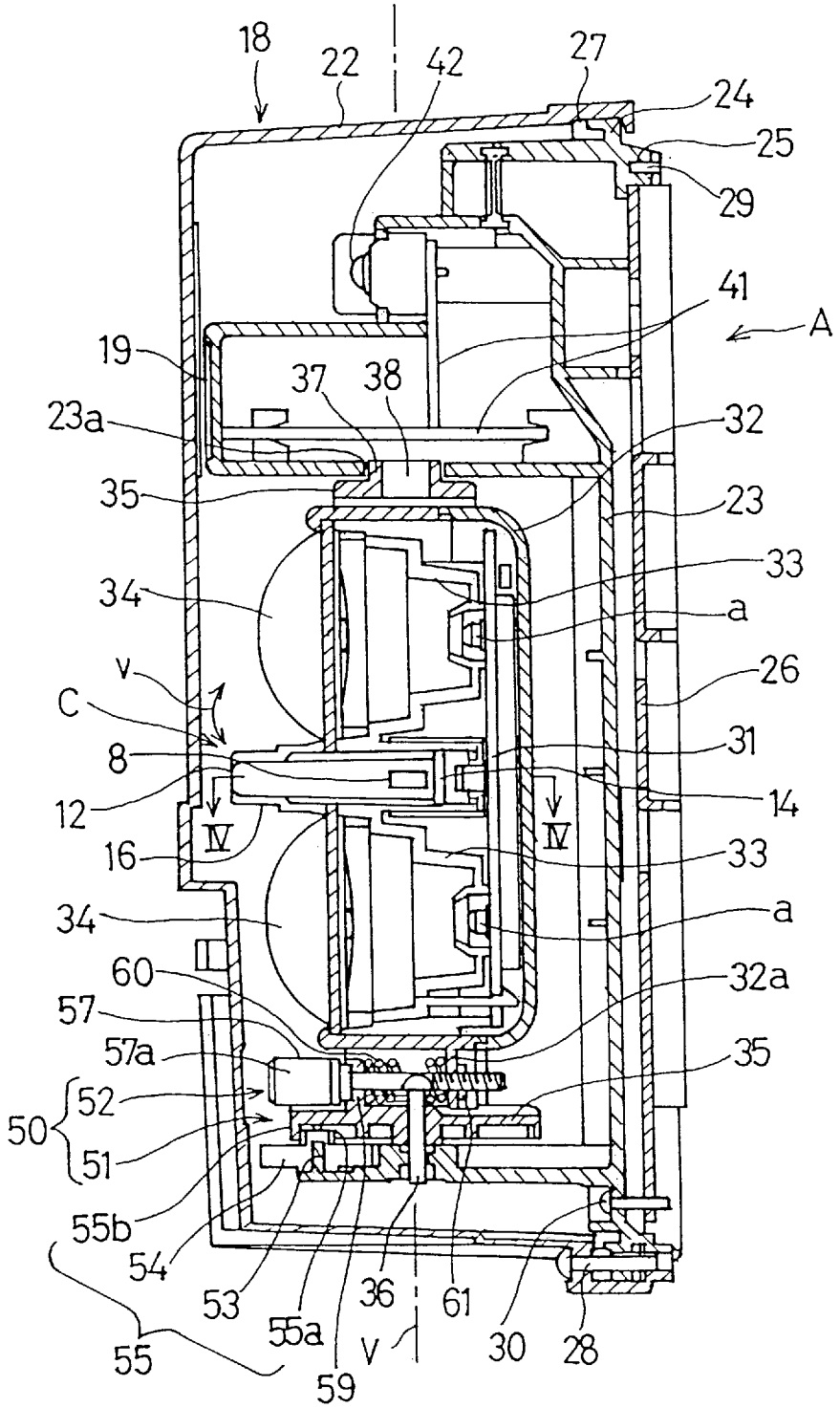
FIG. 3 is a side sectional view of the security sensor.

Referring to FIG. 3, the housing 18 of the beam receiver A includes a generally rectangular box-like cover 22 and a generally rectangular chassis 23 both made of synthetic resin. The cover 22 has an upper portion formed with an engagement step 27 engageable with an engagement projection 24 formed in a corresponding upper portion of the chassis 23. The cover 22 is capped onto the chassis 23 with the engagement step 27 engaged with the engagement projection 24, and the cover 22 so capped is secured to the chassis 23 by means of at least one set screw 28 threaded through a lower portion of the cover 22. The housing 18 also includes a fixture plate 26 provided at a rear thereof for securement to any suitable support such as, for example, a wall or a support pole. This fixture plate 26 is formed with an engagement projection 29 engageable with an engagement step 25 formed in an upper portion of the chassis 23. The fixture plate 26 is fitted to the chassis 23 from rear with the engagement step 25 engaged with the engagement projection 29, and the fixture plate 26 so fitted is secured to the chassis 23 by means of at least one set screw 30 threaded through a lower portion of the chassis 23.

The light receiving elements a shown in FIG. 3 are mounted on a printed circuit board 31 and are accommodated respectively within generally tubular retaining members 33 which are in turn accommodated within a split-type lens casing 32. The lens casing 32 has two lenses 34 fixedly inserted in a front portion of the lens casing 32.

A vertical center portion of the lens casing 32 is, as shown in FIG. 4, rotatably supported by a fixed shaft 35*a* which is a second fixed axis of a lens casing holder 35. Also, as shown in FIG. 3, a lower portion of the lens casing 32 is supported by the lens casing holder 35 by fastening an adjustment screw 57, as will be described later, to a projection 32*a* provided at the lower portion thereof. The lens casing holder 35 has one end (a lower end) that is rotatably supported by the chassis 23 through a support shaft 36 which defines a first axis. The opposite end (an upper end) of the lens casing holder 35 is formed with a stud shaft 37 which is in turn rotatably engaged in a support hole 23*a* defined in the chassis 23. The stud shaft 37 has a cord insertion hole 38 defined therein through which a cord (not shown) extending from the printed circuit board 31 is inserted. Also, as shown in FIG. 3, an upper portion of the beam receiver A is provided with the display unit 19 and a terminal portion 42 both connected with a printed circuit board 41.

Figure 5A:
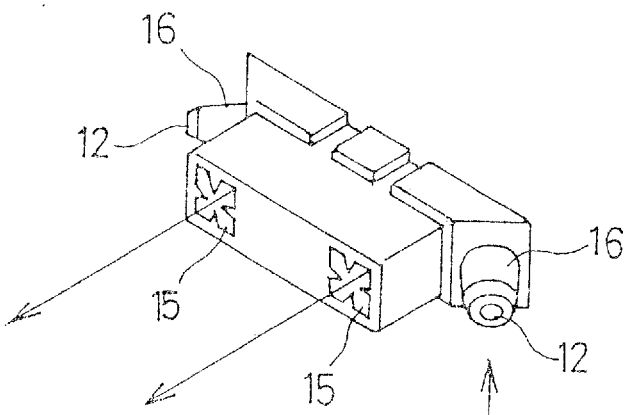
FIG. 5 is a perspective view showing the sighting device.
Figure 5B:
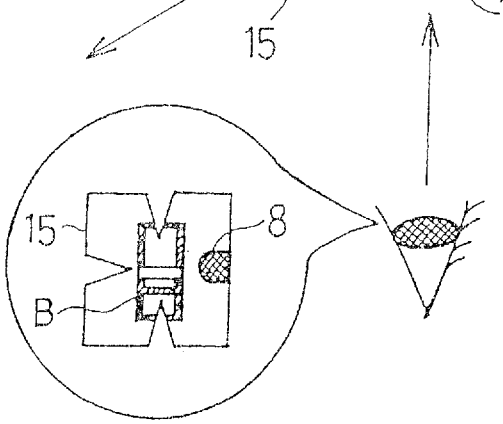

The mirror-equipped sighting device C is mounted in the lens casing 32 and can be exposed to the outside when the cover 22 is removed from the chassis 23. This sighting device C includes, as shown in FIG. 4, the viewing window 12 and the mirror 14 both provided on each of left and right sides thereof, and further includes a sighting hole 15 on each of the left and right sides thereof, with the optical axis rough adjustment display lamp 8 disposed between the mirrors 14. Each of the viewing windows 12 is provided with a field limiting frame member 16 having a length greater than twice the aperture size as best shown in FIG. 5. The optical axis rough adjustment display lamp 8 is, as shown in FIG. 4, positioned in the vicinity of the mirrors 14 and such a position that it will not intercept the field of coverage of the mirrors 14 when the mirrors 14 are viewed through the viewing windows 12.

Figure 2:
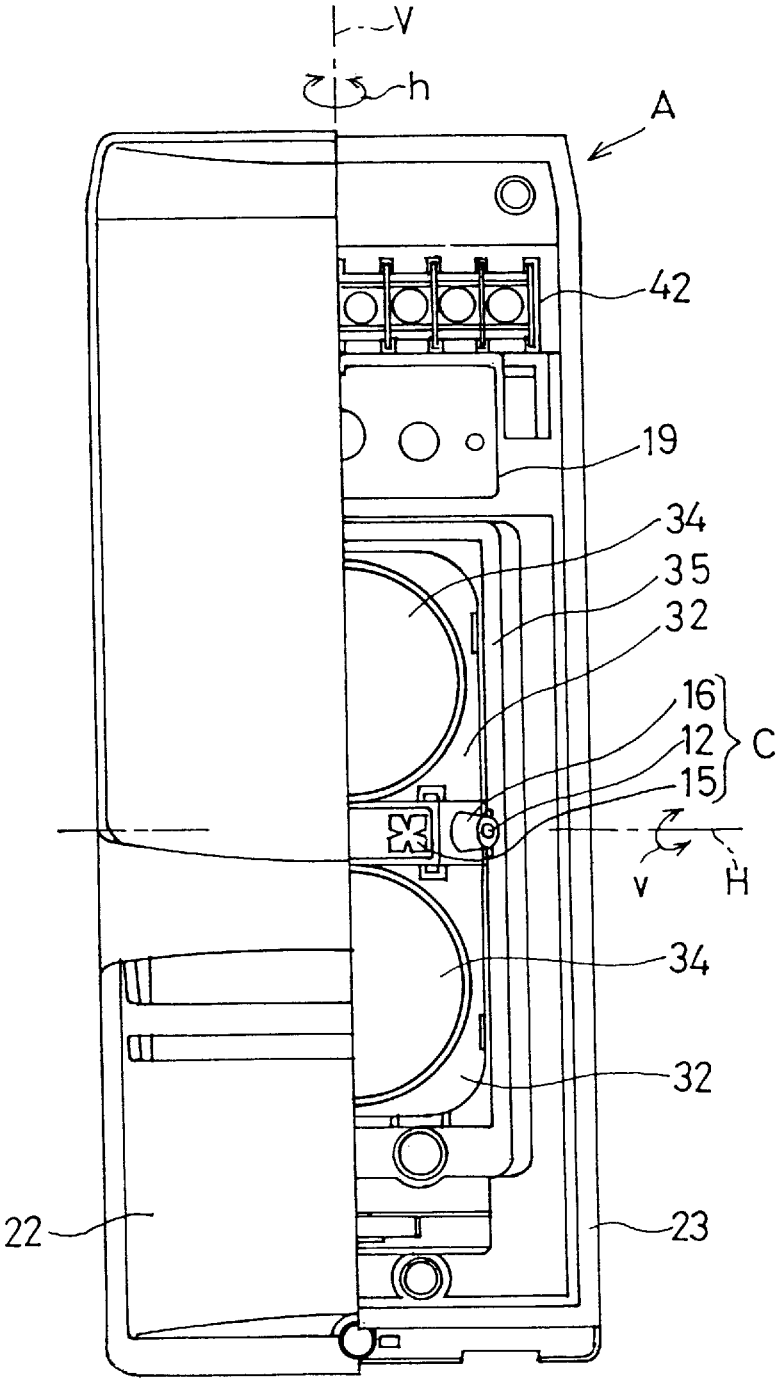
FIG. 2 is a front elevational view, with a right half thereof cut away, of the security sensor.

The adjusting means 50 shown in FIG. 3 includes first and second adjustment units 51 and 52. The first adjustment unit 51 includes a manually operable rotary dial 54 rotatable about a support shaft 53 that extends parallel to the support shaft (first axis) 36, and a gear train 55 drivingly associated with the rotary dial 54 so as to rotate about the support shaft 36 the lens casing holder 35 which supports the casing 32 having the light receiving elements a accommodated therein. This gear train 55 includes a drive gear 55*a* which is in the form of an externally threaded gear formed on an center portion of the dial 54, and a driven gear 55*b* which is in the form of an internally threaded gear formed on a confronting surface of the lens casing holder 35. Thus, the casing 32 has a horizontal angle (in a direction shown by h in FIG. 2) that displaces about a vertical axis V in response to rotation of the rotary dial 54.

The second adjusting unit 52 includes the adjustment screw 57 mounted on a support flange 59 and rotatable when a manipulatable knob 57*a* is manually turned, a coil spring 60 interposed between the projection 32*a*, into which the adjustment screw 57 is threaded, and the support flange 59, and a stopper 61 in the form of a nut threadingly fastened to the adjustment screw 57. When the adjustment screw 57 is rotated, the projection 32*a* moves axially relative to the adjustment screw 57 to cause the lens casing 32 to rotate about the fixed shaft (second axis) 35*a* shown in FIG. 4, that is, about a horizontal axis H to thereby adjust the vertical angle (in a direction shown by v in FIG. 2).

The manner in which the optical axis is adjusted in the security sensor equipped with the sighting device according to the present invention will be described hereinafter.

In the first place, the cover 22 has to be removed from the chassis 23. After the removal of the cover 22, respective optical axes of the beam projector B and the beam receiver A in FIG. 1 have to be generally aligned with naked eyes. Then, utilizing the sighting device C of the beam projector B, the optical axis is roughly adjusted as is the case with the beam receiver A which will subsequently be described. Rough adjustment of the optical axis of the beam receiver A is carried by, as shown in FIG. 5, manipulating the dial 54 of the first adjusting unit 51 or the adjustment screw 57 of the second adjusting unit 52 shown in FIG. 3 while looking through either one of the left and right viewing windows 12 from a lateral side of the beam receiver A, so that an image of the beam projector B cast on the corresponding mirror 14 can be brought to a center of the sighting hole 15 shown in FIG. 5. Since the viewing windows 12 are provided with the respective field limiting frame members 16, the mirrors 14, not the optical axis rough adjustment display lamp 8 then lit, can be assuredly viewed when the worker or user looks through the viewing window 12. This is effective to avoid the possibility that depending on the angle of view the mirror 14 may be hard to be viewed because the optical axis rough adjustment display lamp 8 when lit is noticeable enough to draw the attention of the worker or user.

Figure 7:
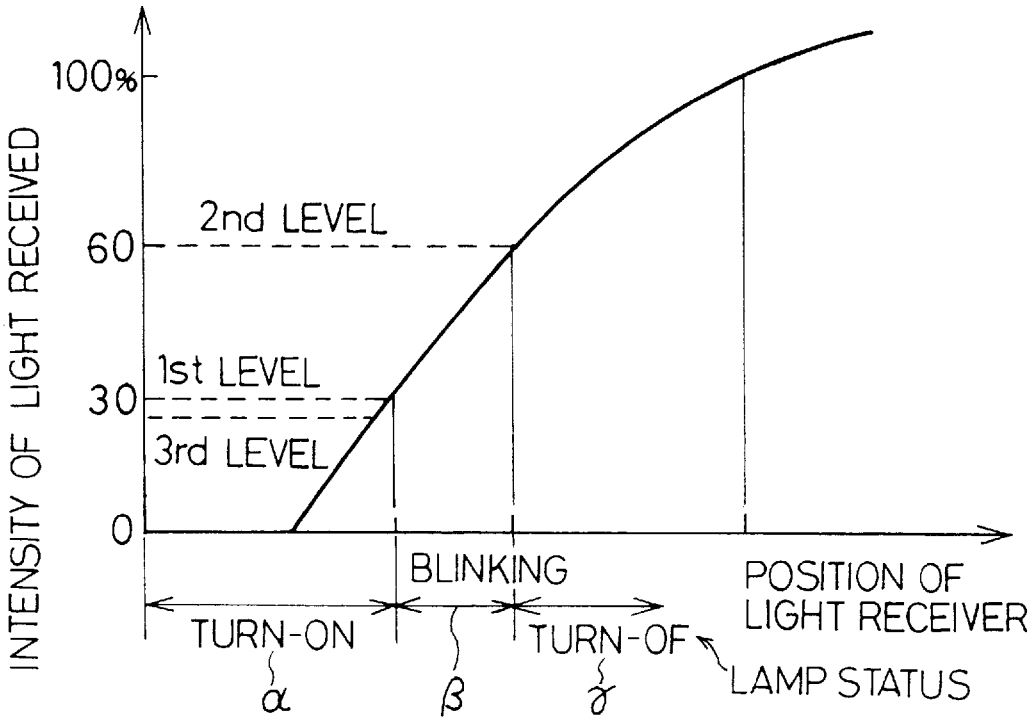
FIG. 7 is a chart showing the relation between the intensity of light received by a beam receiver and the status of an optical axis rough adjustment display lamp in the security sensor.

The relation between the intensity of light received by the beam receiver A and the status of the optical axis rough adjustment display lamp 8 is shown in FIG. 7. If the optical axis of the beam projector B is out of alignment with that of the beam receiver A, the lamp control signal S0 is outputted from the first lamp control means 6 shown in FIG. 1 to cause the optical axis rough adjustment display lamp 8 to be consequently turned on as shown by α in FIG. 7. When the vertical and horizontal angles of the light receiving elements a are adjusted by turning the dial 54 and the adjustment screw 57, and when as a result thereof the orientation of the optical axis falls within the tolerance, the lamp control signal S1 is outputted from the first lamp control means 6 to cause the optical axis rough adjustment display lamp 8 to blink as shown by β in FIG. 7. As the vertical and horizontal angles of the light receiving elements a are further adjusted, the beam projector B is aligned with the center of the sighting hole 15 as shown in FIG. 5 with the orientation of the optical axis consequently aligned and when the signal from the level detecting means 3 therefore exceeds about 60% of the maximum value exhibited when the optical axes are completely aligned with each other, the lamp control signal S2 is outputted from the first lamp control means 6 to cause the optical axis rough adjustment display lamp 8 to be consequently turned off as shown by γ in FIG. 7. In this way, the rough adjustment of the optical axis is accomplished.

After the optical axis adjustment described above, the monitor jacks connected with the tester T are then inserted into the pin holes P provided at opposite end portions of the display unit 19 shown in FIG. 6 to ascertain the signal level of the electric signal indicative of the beam received by the beam receiver A, that is, the level of the output signal from the level signal detecting means 3. By reading an indication of the level displayed by the tester T, the vertical and horizontal angles of the light receiving elements a have to be finely adjusted to such an extent as to attain an optimum condition of the optical axes with the signal level consequently exceeding the predetermined value.

At this time, since the optical axis rough adjustment display lamp 8 is also provided on the display unit 19 mounted on top of the beam receiver A, the status of the optical axis rough adjustment display lamp 8 is also displayed even outside the sighting device C in correspondence with the optical axis adjustment and, therefore, the optical axis rough adjustment display lamp 8 within the sighting device C need not be viewed.

In this way, the optical axes are finally adjusted and the security sensor is installed. The security sensor so installed operates in such a manner that when the infrared beam IR emitted from the beam projector B shown in FIG. 1 is intercepted, the warning signal k0 is outputted from the second lamp control means 9 to cause the warning lamp 7 to be turned on and also to supply the warning output to the outside, but when and so long as the infrared beam IR is not intercepted, the second lamp control means 9 keeps the warning lamp 7 turned off.

Thus, according to the present invention, the optical axis adjustment can be accomplished by ascertaining the level of the received light in terms of the status of the light emitting element which varies depending on the amount of light received from the beam projector while the worker or user views through the viewing windows in the sighting device from the lateral side of the beam receiver. Accordingly, the optical axis adjustment can easily be accomplished in a short period of time. Also, since when the orientation of the optical axis is within the tolerance, that is, in the status after the optical axis adjustment, the optical axis rough adjustment display lamp 8 is turned off, the amount of an electric power consumed after the optical axis adjustment can be reduced to accomplish energy saving.

It is to be noted that while in the foregoing preferred embodiment of the present invention, the first lamp control means 6 has been described as operable to cause the status of the optical axis rough adjustment display lamp 8 to be selectively turned on, blink and turned off (three stages), it may be designed to cause the optical axis rough adjustment display lamp 8 to be selectively turned on and off (two stages) without permitting the optical axis rough adjustment display lamp 8 to blink. In such case, the device as a whole can be simplified in structure, but the adjustment will be somewhat rough.

A second preferred embodiment of the present invention will now be described.

Figure 8:
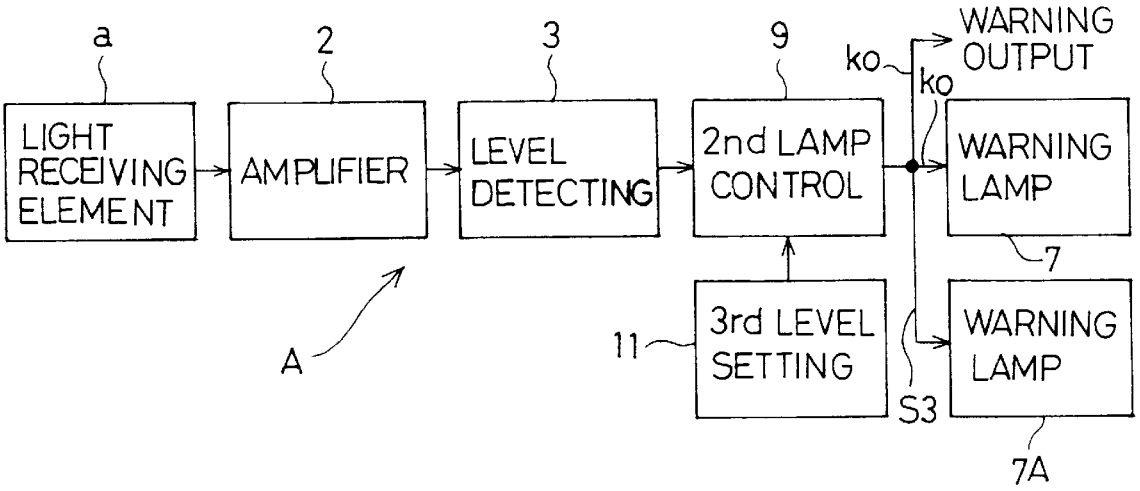
FIG. 8 is a circuit block diagram showing the beam receiver employed in the security sensor equipped with the sighting device according to a second preferred embodiment of the present invention.
Figure 9:
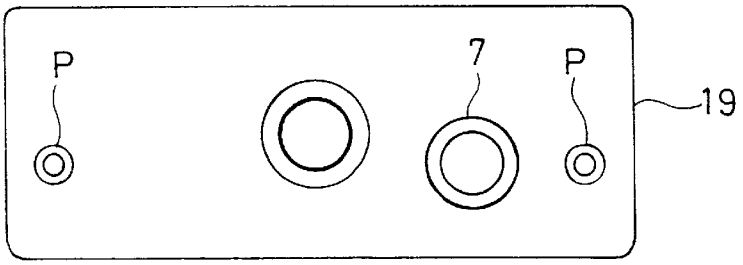
FIG. 9 is a front elevational view of a display unit employed in the security sensor equipped with the sighting device according to the second embodiment of the present invention.

FIG. 8 illustrates the structure of the security sensor equipped with the sighting device according to the second preferred embodiment of the present invention, and FIG. 9 illustrates a display unit 19 used therein. Referring to FIG. 8, the security sensor according to the second embodiment of the present invention is not provided with either the first lamp control means 6 and the optical axis rough adjustment display lamp 8 shown in FIG. 1B and, therefore, the display unit 19 used therein is not provided with the optical axis rough adjustment display lamp 8. The display unit 19 employed in the security sensor according to the second embodiment of the present invention is provided with the warning lamp 7 and a warning display lamp (a light emitting element) 7A for displaying an optical axis rough adjustment is provided in the sighting device C in place of the optical axis rough adjustment display lamp 8, such that the optical axis adjustment can be carried out by the utilization of the second lamp control means 9 and the warning display lamp 7A within the sighting device C. Other structural features are similar to those in the first embodiment of the present invention and the details thereof are not herein reiterated for the sake of brevity.

At the time of the optical axis adjustment, the second lamp control means 9 shown in FIG. 8 outputs the lamp control signal S3 when the signal level outputted from the level detecting means 3 is of a value not exceeding the third level set by the third level setting means 11, that is, when the orientation of the optical axis is not aligned, to thereby cause the warning display lamp 7A, indicative of the optical axis rough adjustment within the sighting device C, to be turned on. On the other hand, when the signal level is of a value higher than the third level, that is, when the orientation of the optical axis is within the tolerance, the second lamp control means 9 ceases outputting the lamp control signal S3, causing the warning display lamp 7A to be turned off. The lamp control signal S3 is identical with the warning signal k0 and, accordingly, the status of the warning display lamp 8 can be ascertained by means of the warning lamp 7. In this way, the rough optical axis adjustment is carried out and, subsequently, the optical axis is finely adjusted in a manner similar to that described in connection with the first embodiment of the present invention, followed by installation of the security sensor. After the security sensor has been installed and when the infrared beam IR emitted from the beam projector B shown in FIG. 1 is intercepted, the second lamp control means 9 shown in FIG. 8 outputs the warning signal k0 to cause the warning lamp 7 (FIG. 9) to be turned on and at the same time supplies the warning output to the outside.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A security sensor equipped with a sighting device, comprising a beam projector having a beam projecting element, a beam receiver having a light receiving element for receiving a beam emitted from the beam projector, and a sighting device for adjusting an optical axis, said beam receiver comprising:

an adjusting means for adjusting the optical axis;

a mirror-equipped sighting device having a viewing window through which viewing is possible from a lateral side of the beam receiver, and including a mirror accommodated therein for presenting an image of the beam projector and a light emitting element which is turned on at the time of adjustment of the optical axis; and a lamp control means for changing a status of the light emitting element in correspondence with the amount of light received from the beam projector.

2. The security sensor equipped with the sighting device as claimed in claim 1, wherein said light emitting element is disposed in the vicinity of the mirror and at such a position that when viewed through the viewing window the field of view of the mirror will not be intercepted.

3. The security sensor equipped with the sighting device as claimed in claim 2, wherein said viewing window and said mirror of the sighting device are provided for each of left and right sides and wherein said light emitting element is disposed therebetween.

4. The security sensor equipped with the sighting device as claimed in claim 1, wherein said lamp control means is of a type capable of causing the light emitting element to be selectively turned on, blink and turned off in dependence on the amount of light received from the beam projector.

5. The security sensor equipped with the sighting device as claimed in claim 1, wherein said lamp control means is of a type capable of changing the color of the light emitting element in dependence on the amount of light received from the beam projector.

6. The security sensor equipped with the sighting device as claimed in claim 1, wherein said lamp control means is of a type capable of switching the light emitting element off when the orientation of the optical axis is within a tolerance.

7. The security sensor equipped with the sighting device as claimed in claim 1, further comprising a field limiting frame member disposed in the viewing window, said field limiting frame member having a length greater than twice an aperture size.

8. The security sensor equipped with the sighting device as claimed in claim 1, wherein said light emitting element has an alarm function with which a lighting condition varies when a beam which the beam receiver receives from the beam projector is intercepted.

9. The security sensor equipped with the sighting device as claimed in claim 1, wherein said adjusting means includes a manually operated dial rotatable about a first axis, and a gear trail drivingly associated with the manually operated dial for rotating a holder for holding the light receiving element about the first axis.

* * * * *